US006035815A

United States Patent [19]

Duret et al.

[11] Patent Number: 6,035,815

[45] Date of Patent: Mar. 14, 2000

[54] PROCESS FOR DELIVERING AND FOR METERING AT LEAST ONE ADDITIVE TO THE COMBUSTION CHAMBER OF AN ENGINE AND ASSOCIATED APPLICATIONS

[75] Inventors: Pierre Duret, Sartrouville; Jacques Lavy, Buc; Stéphane Venturi, La Rochette; Xavier Montagne, Paris, all of France

[73] Assignee: Institut Francais Du Petrole, Rueil-Malmaison, France

[21] Appl. No.: 08/836,130

[22] PCT Filed: Jul. 25, 1996

[86] PCT No.: PCT/FR96/01173

§ 371 Date: Aug. 15, 1997

§ 102(e) Date: Aug. 15, 1997

[87] PCT Pub. No.: WO97/09518

PCT Pub. Date: Mar. 13, 1997

[30] Foreign Application Priority Data

Sep. 8, 1995 [FR] France ..... 96 10798

[51] Int. Cl.[7] ..... F02B 33/04

[52] U.S. Cl. ..... 123/73 AD; 123/1 A

[58] Field of Search ..... 123/73 AD, 1 A

[56] References Cited

U.S. PATENT DOCUMENTS

| | | | |
|---|---|---|---|
| 4,198,931 | 4/1980 | Malec | 123/1 A |
| 4,445,468 | 5/1984 | Onishi et al. | 123/73 C |
| 4,621,593 | 11/1986 | Rao et al. | 123/1 A |
| 5,330,667 | 7/1994 | Tiffany, III et al. | 252/49.6 |

FOREIGN PATENT DOCUMENTS

| | | |
|---|---|---|
| 0365081 | 4/1990 | European Pat. Off. . |
| 2515260 | 4/1983 | France . |

*Primary Examiner*—Noah P. Kamen

*Attorney, Agent, or Firm*—Antonelli, Terry, Stout & Kraus, LLP

[57] ABSTRACT

The present invention relates to a process for delivering and for metering additives to the combustion chamber of an internal-combustion engine consuming a known and controlled amount of lubricant, according to which the lubricant consumed comprises at least one additive designed to improve the quality of the combustion in the chamber. In particular, the additive is designed to promote the combustion of an engine working with controlled self-ignition and to obtain operation in a wider speed and/or load range of the engine.

34 Claims, 1 Drawing Sheet

PROCESS FOR DELIVERING AND FOR METERING AT LEAST ONE ADDITIVE TO THE COMBUSTION CHAMBER OF AN ENGINE AND ASSOCIATED APPLICATIONS

BACKGROUND OF THE INVENTION

1. Field of the Invention

The present invention relates to the field of internal-combustion engines, notably self-ignition engines.

More particularly, the present invention applies to engines that consume, for the operation thereof, a known and controlled amount of oil used for its lubricating properties.

2. Description of the Prior Art

For example, engines having an oil consumption regulated according to engine operation parameters such as the load or the speed are well-known. The oil consumption can also be linked with the fuel consumption according to a certain ratio. Engines thus working are for example: two-stroke gasoline engines with a pump sump, lost-oil lubricated, where the oil can be delivered to the intake system or mixed with the fuel in a proportion recommended by the manufacturer.

There are also gasoline or diesel two-stroke engines referred to as "wet sump" engines (four-stroke type sump) for which a controlled oil consumption allows lubrication of the piston-jacket unit. This consumption can be obtained through a controlled lubricating oil escape into the combustion chamber via for example a relative seal at the level of the rings.

It is also well-known to deliver lubricant to the intake air supplied by a compressor or a supercharger.

Metering of the oil consumed by the engine and delivered by controlled supply to the combustion chamber of an engine is not limited to two-stroke engines, since there are known works on four-stroke engines with dry sumps used as air supercharging pumps that are also lost-oil lubricated.

For these various types of motors, a very great number of lubricants are available on the commercial market. Each lubricant corresponds to a particular engine type according to specifications fixed by engine manufacturers and lubricant makers. For example, for two-stroke engines, down-market and very cheap commercial oils are available for simple two-wheeler applications (motorbike). Other lubricants are available for high-performance applications (motorcyles), others for marine applications (outboard).

These various examples show that each lubricant is intended for a given specific engine.

Furthermore, when the lubricant is thus consumed in a controlled way and therefore participates in the combustion of the engine, it may, according to the invention, be loaded with additives that will allow improvement of the quality of the combustion according to one or several quality criteria such as, for example, minimum pollutant emissions, the highest efficiency, the best cycle regularity, cleanliness, . . . etc.

Usually, such additives are mixed with the fuel and they are then intended for specific functions such as pollutant emissions reduction, soot formation reduction, regeneration of filters located in the exhaust system, detergency.

French Patent 2,702,009, U.S. Pat. No. 4,621,593 or European Patent 269,228 disclose various methods for supplying an engine fuel with an additive.

However, a marketed and distributed fuel already containing an additive is hard to conceive when the required additive is not necessary for a whole fleet of vehicles and would be necessary only and specifically for part of a fleet of vehicles on the market.

Although the commercial distribution of fuels containing antifouling additives for example can be contemplated, it is not economically profitable to distribute an additive-containing fuel that would be specifically suited for two-wheelers with two-stroke engines and marine outboard engines.

SUMMARY OF THE INVENTION

The invention is a new and extremely simple solution for supplying the combustion chamber of engines with additives for specific applications, where the additive is not initially mixed with the fuel but with the lubricant.

More precisely, the invention relates to a process for delivering and for metering additives to the combustion chamber of an internal-combustion engine consuming a known and controlled amount of lubricant, a process according to which the consumed lubricant comprises at least one additive designed to improve the quality of the combustion in the chamber.

In particular, the additive is intended to promote the combustion of an engine working with controlled self-ignition and to obtain operation in a wider speed and/or load range of the engine.

According to an embodiment of the invention, the additive-containing lubricant is mixed with the fuel by the user.

According to another embodiment of the invention, the additive-containing lubricant is delivered to the engine intake by a specific metering device.

A particular application of the invention relates to two-stroke engines with a lost-oil lubricated pump sump.

The engine to which the invention applies to can be a two-stroke engine with an external compressor, whose lubricant consumption is obtained through controlled escape via the engine rings.

Without departing from the scope of the invention, the engine may be a four-stroke engine with a lost-oil lubricated pump sump.

According to a feature of the invention, metering of the lubricant can be controlled electronically as a function of parameters such as the speed, the load, the presence or absence of knocking, self-ignition operation or not, etc. . . .

This feature thus allows indirect electronic control of the amount of additive delivered to the combustion chamber, via electronic lubricant metering.

BRIEF DESCRIPTION OF THE DRAWINGS

Other advantages, details and features of the invention will be clear from reading the description hereafter, given by way of non limitative examples, with reference to the accompanying drawings in which.

DESCRIPTION OF THE INVENTION

The process according to the invention uses consists in using an additive-containing lubricant, the formulation of the additive(s) being determined in order to obtain the required effect on the quality of the combustion, and in applying it to an engine in which the consumption of the lubricant is controlled by a suitable metering device (metering pump, calibrated escape, etc). Thus, the amount of lubricant and of fuel participating in the combustion being known, the lubricant according to the invention can precisely comprise the amount of additives that could have been required to participate in the efficient progress of the combustion.

A particularly advantageous example of application of the process according to the invention is the supply of lubricant of a two-stroke engine with an additive so as to promote the self-ignition operation thereof by extending the operating range of the engine according to this self-ignition process.

Figure 1:
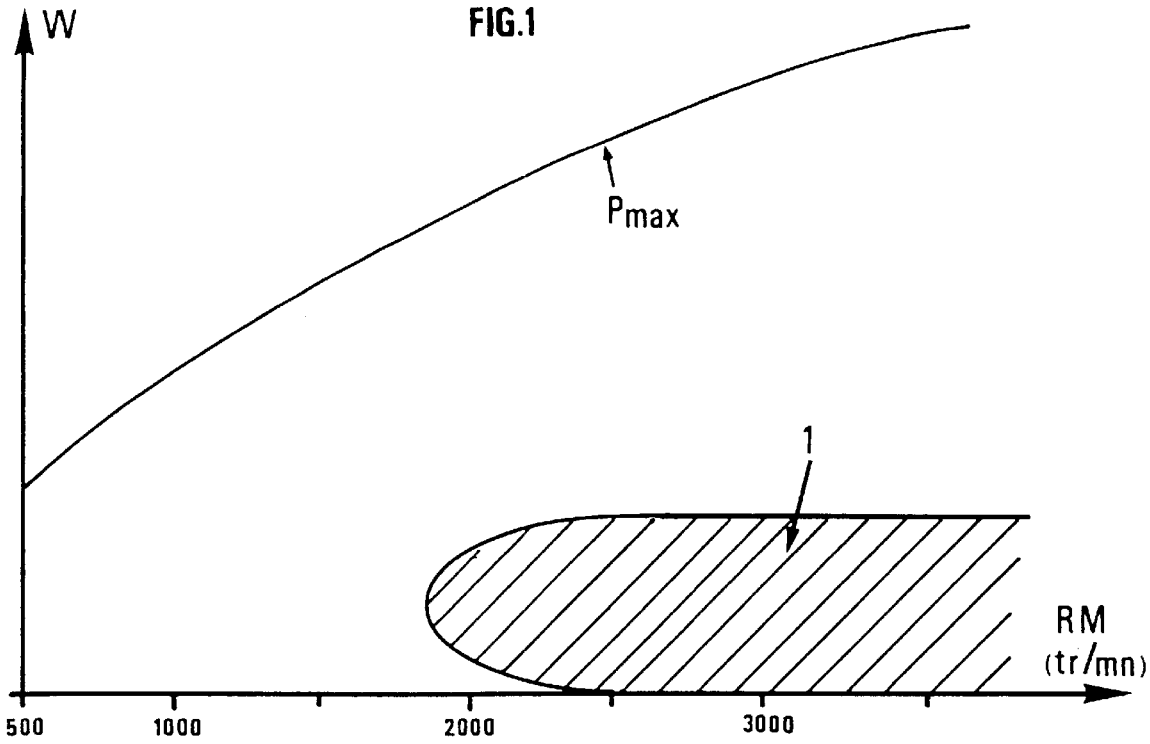
FIG. 1 shows curves defined by the power of a self-ignition engine as a function of its speed according to the prior art.
Figure 2:
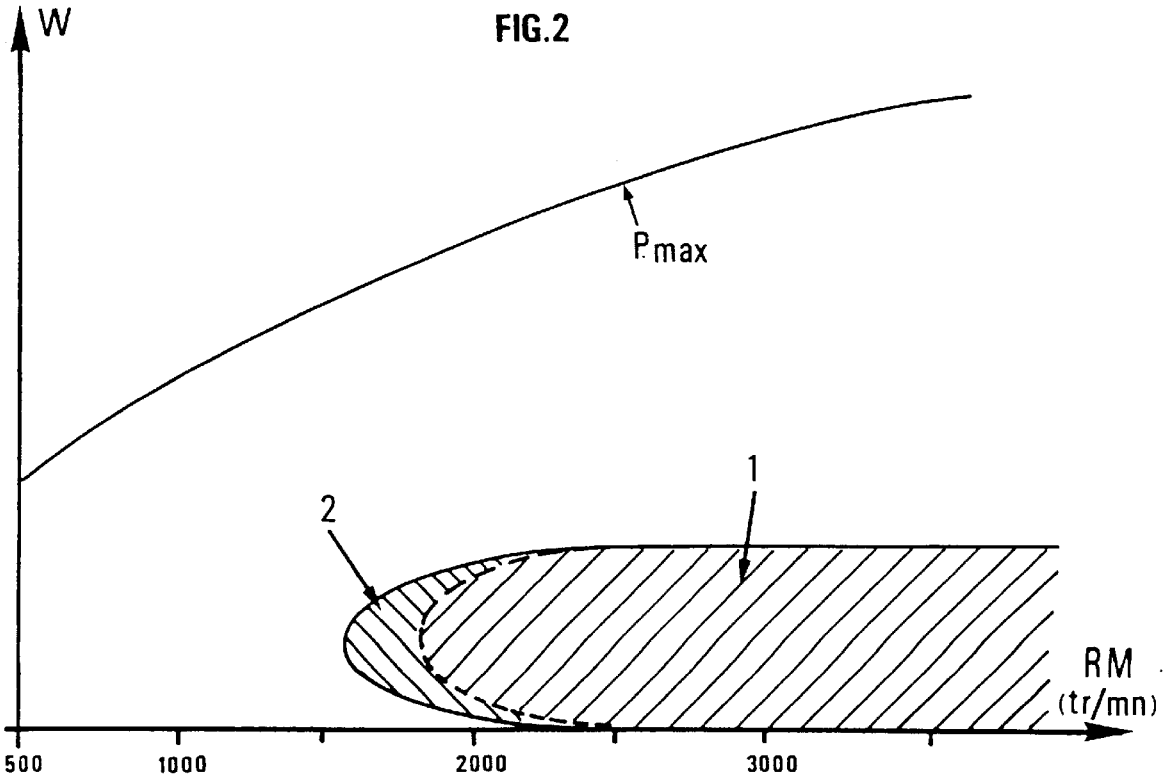
FIG. 2 shows curves determined by the power of a self-ignition engine as a function of its speed according to the invention.

FIGS. 1 and 2 show curves of the engine power W as a function of their speed RM. The curve $P_{max}$ corresponding to the maximum power developed by the engine can be seen in each of the figures.

FIG. 1 shows the operating range of a known two-stroke engine, that is for example the subject of the Assignee's French Patent 2,649,157.

This known engine was designed to have the widest possible self-ignition operating range (1) at low speeds and low loads.

FIG. 2 shows the same operating range of the engine when the lubricant consumed by the engine (in a ratio of about 2% of the fuel consumed) contains about 10% of additives promoting the controlled self-ignition process. This supply of additive to the lubricant according to the invention allows, in this example, to extend the self-ignition operating range to 100 to 200-rpm lower speeds. In fact, whereas in known engines (FIG. 1), self-ignition existed for engine speeds above about 1700 rpm, according to the invention (FIG. 2), self-ignition appears as soon as 1500 rpm for the same engine power.

In particular in the case of two-stroke engines (although application to four-stroke engines is in accordance with invention), there is a well-known particular combustion mode for which the engine can have a self-ignition operation. U.S. Pat. No. 4,445,468 describes an example of such an engine.

Research work shows that this type of combustion is obtained at low loads and at rather high speeds.

It is well-known that parameters linked with the operation of the engine, such as the compression ratio, the internal aerodynamics and the fresh gas/burned gas stratification, the temperature and the pressure in the cylinder at the start of the compression, etc. . . . , have a strong influence on the self-ignition operation and on the extent of the speed and load range where it is obtained.

The parameters linked with the fuel, the composition, the physico-chemical characteristics (octane and cetane number, additives formulation, etc), can also have an influence on this combustion. In particular, recent work shows that certain additives fed into the fuel allow to extend this self-ignition operating range to low speeds with the aim of obtaining self-ignition at engine idling speed. Feeding these additives in a mixed form into the lubricant according to the invention allows the obtaining of the same effects in a very simple way.

Extension of the self-ignition operating range is particularly interesting and sought-after since it allows avoiding of combustion irregularities typical notably of two-stroke engines at low load and low speed.

Unburned hydrocarbon emissions are thus greatly reduced (by about 60%), the fuel efficiency and consumption are improved and the combustion is made particularly stable from one cycle to the next.

It may therefore be advantageously contemplated, according to the invention, marketing additive-containing lubricants for two-stroke engines (two-wheelers, outboard) in order to increase the self-ignition operating range.

According to an embodiment of the invention, the additive-containing lubricant is mixed with the fuel by the user. This may be the case for two-stroke engines supplied, at the level of the fuel tank, with an oil-fuel mixture according to a determined percentage.

According to another embodiment of the invention, the additive-containing lubricant is delivered to the engine intake. This may be the case for two-stroke engines with so-called "separate lubrication" pump sumps where the user fills two tanks, the fuel tank and the lubricant tank. An oil metering system can then mix this oil with the fuel just prior to feeding the carburetor, or the metering system can deliver this oil to the engine intake.

We claim:

1. A process for delivering and for metering additives to a combustion chamber of a self ignition internal combustion engine consuming a known and controlled amount of an engine lubricant, wherein the consumed engine lubricant comprises at least one additive which improves quality of the combustion in the chamber and promotes combustion providing operation over a wider speed and/or load range of the self ignition internal combustion engine.

2. A process as claimed in claim 1, wherein the self ignition internal combustion engine operates as a two-stroke engine having a pump sump lubricated by lost oil.

3. A process as claimed in claim 1, wherein the self ignition internal combustion engine is a two-stroke engine with an external compressor.

4. A process as claimed in claim 1, wherein lubricant consumption is obtained through a controlled lubricant escapement into the combustion chamber via cylinder rings.

5. A process as claimed in claim 1, wherein the self ignition internal combustion engine is a four-stroke engine having a pump sump lubricated by lost oil.

6. A process as claimed in claim 1, wherein the additive-containing lubricant is mixed with the fuel by a user.

7. A process as claimed in claim 6, wherein the additive containing lubricant is delivered to an intake of the self ignition internal combustion engine by a metering device.

8. A process as claimed in claim 7, wherein metering of the lubricant is controlled electronically as a function of engine operation parameters including speed, load, presence or absence of knocking, and self-ignition operation.

9. A process as claimed in claim 8, wherein the self ignition internal combustion engine operates as a two-stroke engine having a pump sump lubricated by lost oil.

10. A process as claimed in claim 7, wherein the self ignition internal combustion engine operates as a two-stroke engine having a pump sump lubricated by lost oil.

11. A process as claimed in claim 7, wherein the self ignition internal combustion engine is a two-stroke engine with an external compressor.

12. A process as claimed in claim 7, wherein lubricant consumption is obtained through a controlled lubricant escapement into the combustion chamber via cylinder rings.

13. A process as claimed in claim 7, wherein the self ignition internal combustion engine is a four-stroke engine having a pump sump lubricated by lost oil.

14. A process as claimed in claim 6, wherein the self ignition internal combustion engine is a two-stroke engine with an external compressor.

15. A process as claimed in claim 6, wherein lubricant consumption is obtained through a controlled lubricant escapement into the combustion chamber via cylinder rings.

16. A process as claimed in claim 6, wherein the self ignition internal combustion engine is a four-stroke engine having a pump sump lubricated by lost oil.

17. A process as claimed in claim 6, wherein the self ignition internal combustion engine operates as a two-stroke engine having a pump sump lubricated by lost oil.

18. A process as claimed in claim 6, wherein metering of the lubricant is controlled electronically as a function of engine operation parameters including speed, load, presence or absence of knocking, and self-ignition operation.

19. A process as claimed in claim 18, wherein the self ignition internal combustion engine operates as a two-stroke engine having a pump sump lubricated by lost oil.

20. A process as claimed in claim 18, wherein the self ignition internal combustion engine is a two-stroke engine with an external compressor.

21. A process as claimed in claim 18, wherein lubricant consumption is obtained through a controlled lubricant escapement into the combustion chamber via cylinder rings.

22. A process as claimed in claim 1, wherein the additive-containing lubricant is delivered to an intake of the self ignition internal combustion engine by a metering device.

23. A process as claimed in claim 22, wherein metering of the lubricant is controlled electronically as a function of engine operation parameters including speed, load, presence or absence of knocking, and self-ignition operation.

24. A process as claimed in claim 23, wherein the self ignition internal combustion engine operates as a two-stroke engine having a pump sump lubricated by lost oil.

25. A process as claimed in claim 23, wherein the self ignition internal combustion engine is a two-stroke engine with an external compressor.

26. A process as claimed in claim 22, wherein the self ignition internal combustion engine operates as a two-stroke engine having a pump sump lubricated by lost oil.

27. A process as claimed in claim 22, wherein the self ignition internal combustion engine is a two-stroke engine with an external compressor.

28. A process as claimed in claim 22, wherein lubricant consumption is obtained through a controlled lubricant escapement into the combustion chamber via cylinder rings.

29. A process as claimed in claim 23, wherein lubricant consumption is obtained through a controlled lubricant escapement into the combustion chamber via cylinder rings.

30. A process as claimed in claim 22, wherein the self ignition internal combustion engine is a four-stroke engine having a pump sump lubricated by lost oil.

31. A process as claimed in claim 1, wherein metering of the lubricant is controlled electronically as a function of engine operation parameters including speed, load, presence or absence of knocking, and self-ignition operation.

32. A process as claimed in claim 31, wherein the self ignition internal combustion engine is a two-stroke engine with an external compressor.

33. A process as claimed in claim 31, wherein lubricant consumption is obtained through a controlled lubricant escapement into the combustion chamber via cylinder rings.

34. A process as claimed in claim 31, wherein the self ignition internal combustion engine is a four-stroke engine having a pump sump lubricated by lost oil.

* * * * *